US008033343B2

(12) United States Patent
Barrows et al.

(10) Patent No.: US 8,033,343 B2
(45) Date of Patent: Oct. 11, 2011

(54) WATER POWERED IMPULSIVE UNIT

(75) Inventors: Alan Barrows, Gloucestershire (GB); Douglas Barrows, Gloucestershire (GB)

(73) Assignee: Glencross Limited, Guernsey (GB)

( * ) Notice: Subject to any disclaimer, the term of this patent is extended or adjusted under 35 U.S.C. 154(b) by 489 days.

(21) Appl. No.: 12/066,217

(22) PCT Filed: Sep. 7, 2006

(86) PCT No.: PCT/GB2006/003326

§ 371 (c)(1),
(2), (4) Date: Jul. 18, 2008

(87) PCT Pub. No.: WO2007/029004

PCT Pub. Date: Mar. 15, 2007

(65) Prior Publication Data

US 2009/0101378 A1 Apr. 23, 2009

(30) Foreign Application Priority Data

Sep. 7, 2005 (GB) ..... 0518249.8

(51) Int. Cl.
*B25D 17/06* (2006.01)

(52) U.S. Cl. ..... 173/78; 173/80; 173/135; 173/206

(58) Field of Classification Search ..... 173/135, 173/78, 80, 206, 197, 91; 175/92; 123/670
See application file for complete search history.

(56) References Cited

U.S. PATENT DOCUMENTS

| | | | | |
|---|---|---|---|---|
| 1,663,403 | A * | 3/1928 | Gilman | 173/65 |
| 1,740,687 | A * | 12/1929 | Gartin | 173/61 |
| 1,918,787 | A * | 7/1933 | Smith, Sr. | 173/68 |
| 3,057,417 | A * | 10/1962 | Sandvig | 175/212 |
| 5,236,787 | A * | 8/1993 | Grassi | 428/552 |
| 5,402,854 | A * | 4/1995 | Kimberlin et al. | 173/17 |
| 5,773,078 | A * | 6/1998 | Skelly | 427/126.3 |
| 6,817,840 | B1 * | 11/2004 | Schwarzkopf | 417/269 |
| 6,952,009 | B1 * | 10/2005 | Engstrand | 250/231.1 |

FOREIGN PATENT DOCUMENTS

| | | |
|---|---|---|
| DE | 3342879 | 6/1985 |
| EP | O171374 | 2/1986 |

* cited by examiner

*Primary Examiner* — Scott A. Smith
(74) *Attorney, Agent, or Firm* — Honigman Miller Schwartz and Cohn LLP

(57) ABSTRACT

An impulsive unit for a jack hammer or rock drill is adapted to be powered by water, and comprises a piston slidable within a cylinder, and carrying a striker portion thereon. At least a portion of the piston and/or cylinder is coated with ceramic. The ceramic is most suitably an aluminum oxide-titanium dioxide composite, which enables the clearance between the internal diameter of the cylinder and the external diameter of the piston to be reduced to between 8 and 10 micro-meters.

18 Claims, 3 Drawing Sheets

WATER POWERED IMPULSIVE UNIT

TECHNICAL FIELD

The present invention relates to a water powered impulsive unit, suitable for use as a drive unit in a jack hammer, otherwise known as a breaker, a rock drill or other impact tool.

BACKGROUND

It is known to use an impulsive unit to power a jack hammer or rock drill. An impulsive unit is typically powered by a closed loop hydraulic system using oil or an oil/water emulsion as the working fluid. This has the disadvantage that should the hydraulic system leak, then oil or oil/water emulsion will pollute the working environment. This is particularly undesirable in confined working environments, such as in deep mines.

Local heating is a significant issue in deep mining since the earth temperatures generally increases between 1.2° C. and 2.6° C. with each 100 meters of descent. For a 4,000 or 5,000 deep mine this could result in an ambient temperature in the region of 60° C., and consequently a significant amount of cooling must be provided in order to enable men to work at these depths.

It is also a problem that jack hammers and rock drills used in deep mines at these depths must also be cooled.

It is not possible to use water as the working fluid in an impulsive unit intended for use with oil or an oil/water emulsion as the working fluid, because the viscosity of water is significantly lower than that of oil or an oil/water emulsion. A typical impulsive unit includes a cylinder and piston, which is actuated by the working fluid. The clearance between the cylinder diameter and piston diameter in an impulsive unit for use with oil or oil/water emulsion is typically between 20 and 50 micro-meters. If such a unit is used with water, rather than oil or oil/water emulsion, such clearances are too great for water pressure to be maintained within the unit. In other words, the water is forced past the piston in the cylinder, rather than actuating the piston. Furthermore, water is not a lubricant, and so even if the clearances between the parts of the impulsive unit are reduced sufficiently to seal the piston against the cylinder, then the components which move relative to one another tend to seize or weld together.

It is an object of the invention to provide an impulsive unit, which can be powered by water and which substantially reduces the above-mentioned problems.

According to a first aspect of the present invention there is provided an impulsive unit adapted to be powered by water comprising a piston slidable within a cylinder, in which at least a portion of the piston and/or cylinder is coated with ceramic.

Preferably, the piston carries a striker portion thereon.

It has been found that by using a ceramic coating on at least a portion of the piston and/or cylinder, the clearances between the piston and the cylinder can be reduced sufficiently to enable water to be used as the working fluid, without the components seizing together. This surprising effect is thought to be caused by water particles becoming trapped in the surface pore structure of the ceramic, so that the piston and cylinder are kept spaced apart in operation. Thus the water is able to lubricate the surfaces as effectively as a film of conventional oil.

Preferably the ceramic coating contains a metal oxide. Most preferably the ceramic coating is an aluminium oxide-titanium dioxide composite.

Preferably the piston and cylinder are substantially cylindrical.

The internal wall of the cylinder may be formed by a sleeve. The clearance between the internal diameter of the cylinder and the external diameter of the piston is preferably between 8 and 10 micro-meters.

Preferably a pressure unit is provided for building up a charge of water under pressure and directing the charge of water under pressure towards a face of the piston. The pressure unit is preferably charged with between 5 and 10 cc gas at between 60 and 70 bar.

A valve means may be provided for controlling the charge of water to and from the cylinder. Preferably the valve means is a spool valve which is slidable with respect to the cylinder.

The impulsive unit may be adapted to operate when supplied with pressurized water at a rate of between 20 and 30 liters per minute. Preferably the water is pressurized to between 100 and 110 bar.

The impulsive unit may deliver around 1350 blows per minute to the tool when the water flow rate is 20 liters per minute. Alternatively the impulsive unit may deliver around 1900 blows per minute to the tool when the water flow rate is 30 liters per minute.

Preferably water is supplied to the impulsive unit from a closed loop supply, which may be cooled and/or filtered with a 10 micro-meter filter.

It is an advantage of the invention that only water is spilt in the event of a leak, which is non-toxic and not flammable. It is a further advantage of the invention that corrosion of the impulse unit is inhibited because it forms a closed loop circuit with substantially no air in the circuit.

The impulsive unit may be used in a jack hammer, a rock drill or any other impact tool.

According to a second aspect of the invention there is provided a tool system for use in mines comprising at least one water powered impulsive unit according to the first aspect of the invention.

Preferably one or more tools are mounted onto a moveable platform such that the tools may be easily advanced along a working seam. Advantageously the platform includes stabiliser means, such as one or more telescoping elements moveable to engage with the roof, sides or floor of a tunnel to hold the platform against motion or toppling when the impulsive units are in use.

According to a third aspect of the invention, there is provided a closed loop hydraulic system, in which water is the working liquid.

Preferably, the closed loop hydraulic system includes a reservoir of water, a pump for supplying water under pressure from the reservoir to a tool, and means for conveying water from the tool back to the reservoir.

The reservoir may be at atmospheric pressure, ie vented to atmosphere. Alternatively, the reservoir may be sealed to atmosphere and maintained at a pressure above or below atmospheric pressure.

Preferably, the tool is an impulsive unit. The impulsive unit may be a jack hammer or rock drill.

For a better understanding of the present invention, and to show more clearly how it may be carried into effect, reference will now be made, by way of example, to the accompanying drawings, in which:—

DETAILED DESCRIPTION OF THE INVENTION

Figure 1:
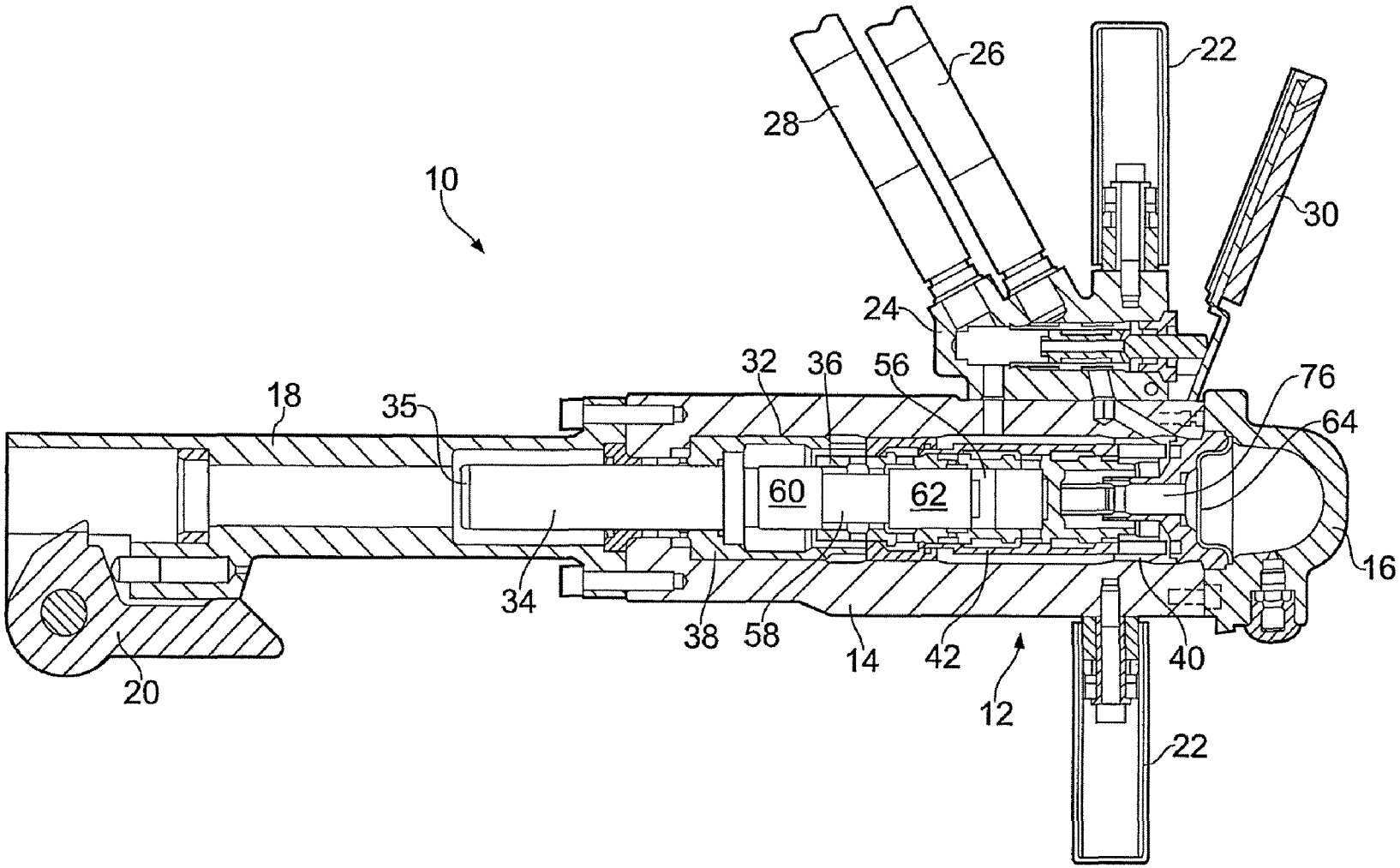
FIG. 1 is a schematic cross-section through an impulse unit incorporated in a jack hammer.

Referring firstly to FIG. 1, a jack hammer or breaker is indicated generally at 10. An impulsive unit indicated generally at 12, is contained substantially within a housing 14. A pressure unit or accumulator 16 is attached to one end of the housing 14, and a tool guide 18 for guiding an impact tool (not shown) is attached to the other end of the housing 14. A tool retainer 20 is provided at the end of the tool guide for releasably retaining a tool, for example a chisel, in the tool guide.

A master fluid control valve 24 is attached to the side of the housing 14 and is operated manually by a trigger 30. A working fluid supply line 26 and a return line 28 are connected to the master fluid control valve 24. The jack hammer 10 has two handles 22, one of which is bolted to the master fluid control valve 24, and the other of which is bolted directly to the housing 14.

The housing 14 has an internal chamber 32 forming a cylinder, in which the operating parts of the impulsive unit 12 are substantially contained. A piston 34 carrying a striker portion 35 thereon is held coaxially within the chamber 32 within the housing 14. The piston 34 is mounted in sliding engagement within a striker sleeve 36 which is secured to the housing by annular mounting elements 38 and 40 respectively. A sliding spool valve 42 is concentrically mounted around the striker sleeve 36 in a cylindrical space bounded by the striker sleeve 36, the housing 14 and the angular mounting elements 38 and 40. The striker sleeve 36 is provided with a plurality of ports, which are selectively covered and uncovered by either the piston 34 or the spool valve 42 in order to control fluid flow to and from a working cavity 56. The piston has a waisted portion 58 provided between portions 60 and 62 of the piston which, in use, are substantially fluid sealed in sliding engagement with the sleeve 36.

The portions of the piston 34 which are in sliding engagement with the internal surfaces of the sleeve 36 are coated with ceramic. Alternatively, the portions of the sleeve 36 which are in sliding engagement with the piston 34 are coated with ceramic. The ceramic coating contains a metal oxide, and is most preferably an aluminium oxide-titanium dioxide composite. The clearance between the internal diameter of the sleeve 36 and the external diameter of the piston 34 is between 8 and 10 micro-meters. This clearance allows for movement between the piston and the sleeve, but is also small enough to provide a seal against high pressure water acting on the end of the piston 34.

The pressure unit 16 is sealed by a flexible diaphragm 64, and is pressurized with gas, typically nitrogen to a pressure of between 60 and 70 bar. The pressure unit contains between 5 and 10 cc gas at this pressure.

In use, water at high pressure, typically between 100 and 110 bar is supplied to the jack hammer 10 at a rate of between 20 and 30 liter/min. The pressurized water passes through the control valve 24 and into a chamber 76 in front of the flexible diaphragm 64. The gas in the pressure unit 16 is compressed, and a charge of water held under pressure builds up. When the charge of water reaches a certain volume and pressure, the spool valve 42 is displaced longitudinally and the charge of water is directed into the working cavity 56 and acts on the end of the piston 34. This causes the piston to slide axially within the sleeve 36 towards the tool (not shown) held within the tool guide. The end of the piston strikes the end of the tool, causing the tool to move forward. The spool valve 40 controls the return of the piston 44 for another cycle.

The impulsive unit delivers approximately 1350 blows/minute to the tool when the flow rate is 20 liters/min. When the water flow rate is increased to 30 liters/min, the impulsive unit 12 delivers approximately 1900 blows/min to the tool.

Water supplied to the impulsive unit 10 is from a closed loop supply, which is cooled and filtered with a 10 micrometers filter. The water is filtered in the return line, where the pressure is low. The ability to use water as a working fluid has the advantages that should the closed loop supply leak, there is no risk to health and safety because water is non-toxic and non-flammable.

Figure 2:
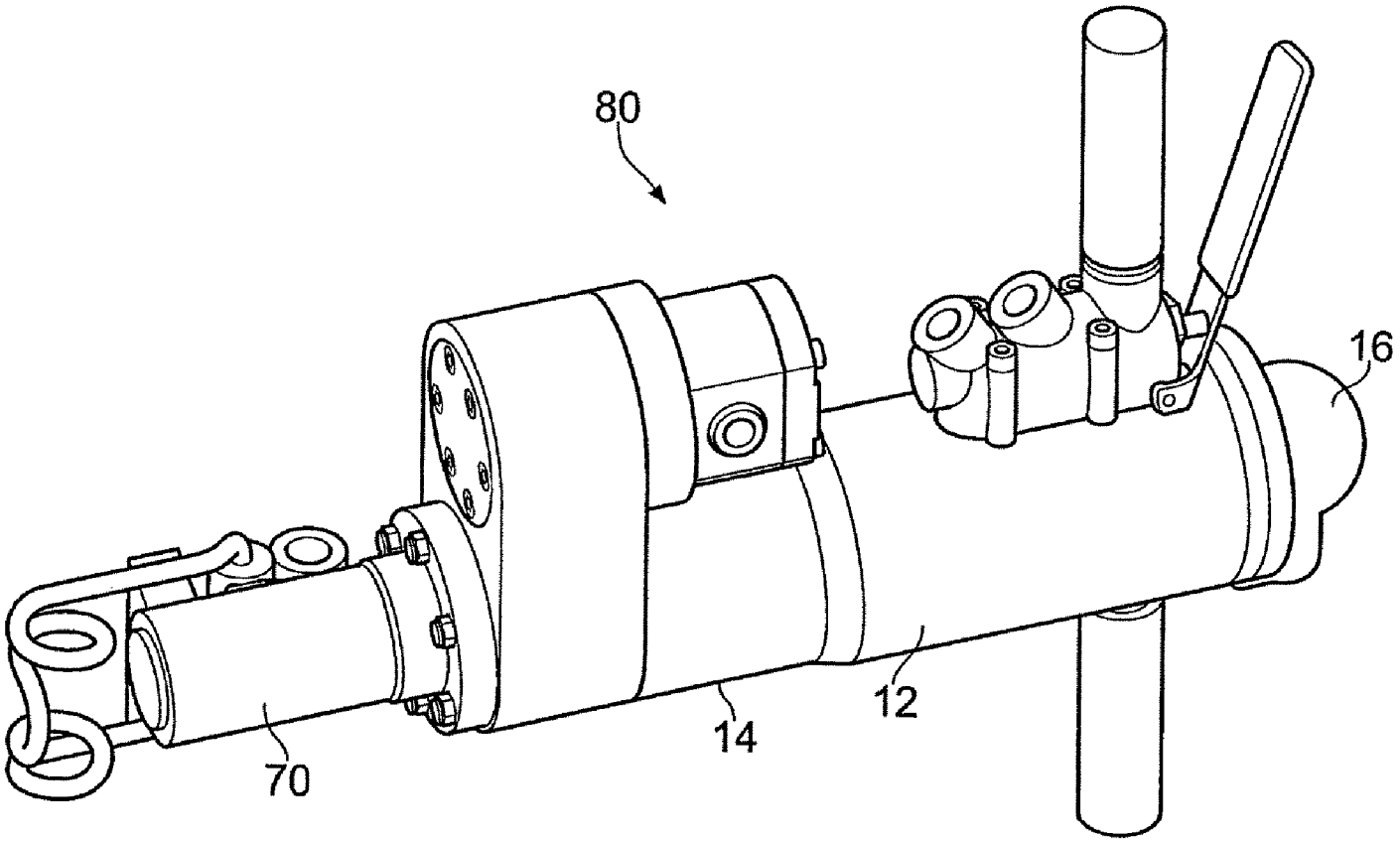
FIG. 2 is a perspective view of a rock drill incorporating an impulse unit.
Figure 3:
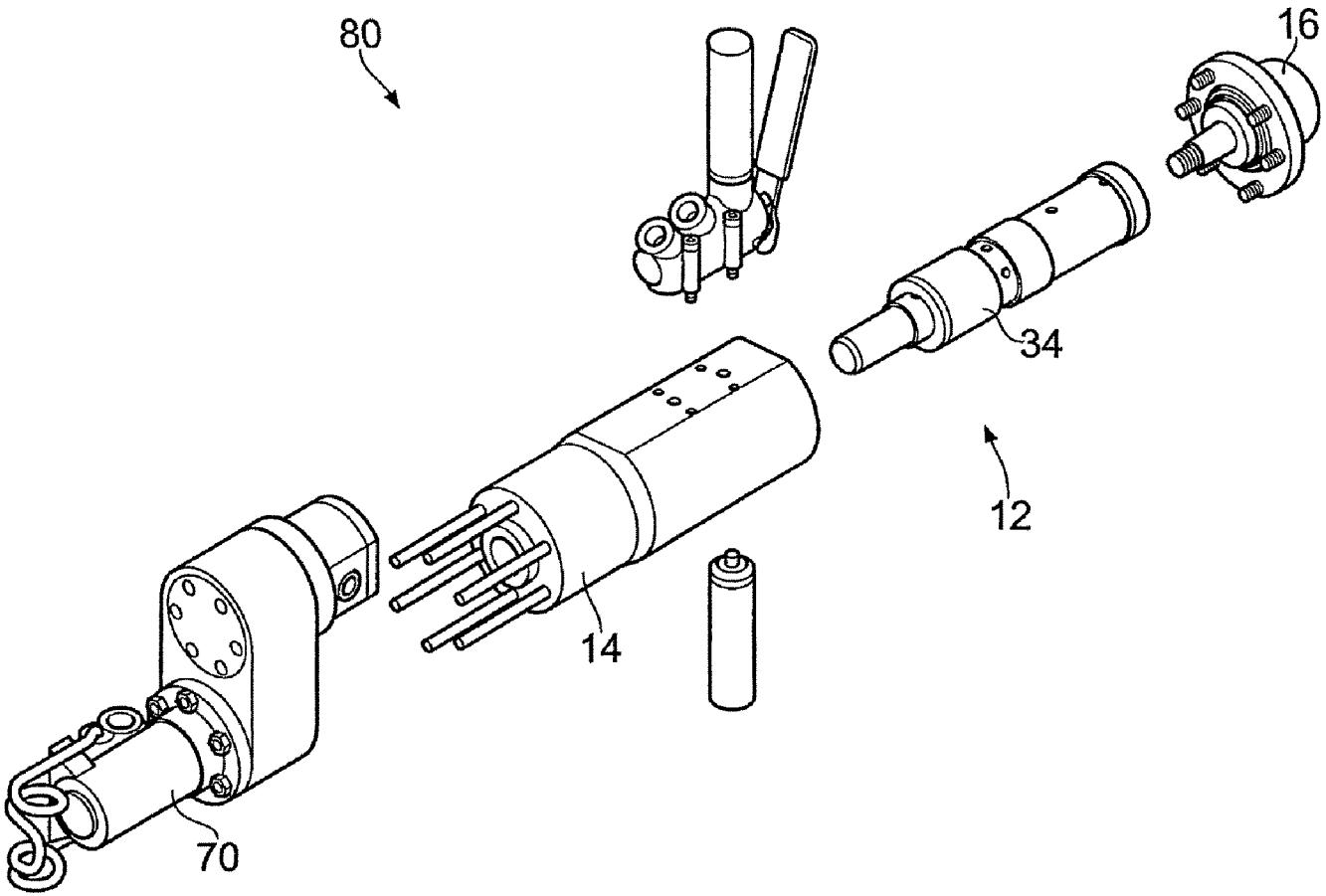
FIG. 3 is a part-exploded perspective view of the rock drill of FIG. 2.

The impulsive unit 12 is shown in FIGS. 2 and 3 in a rock drill, indicated at 80. The impulsive unit 12 is retained in the same housing 14 and operates in exactly the same manner with a pressure unit or accumulator 16. However, the housing 14 is attached to a tool guide 70, which incorporates a hydraulic motor, which is again powered by water, for rotating the drill. The piston 34 acts on the end of a tool in the form of a drill in exactly the same manner as on a tool in the jack hammer 10.

In order to increase productivity in a mine, a number of tools (not shown) may be mounted on a movable platform such that the tools may be easily advanced along working seam. The platform may be stabilised with telescoping elements which are movable to engage with the roof, sides or floor of a tunnel to hold the platform against motion or toppling when the impulsive units are in use.

The invention claimed is:

1. An impulsive unit adapted to be powered by water, comprising:

a piston slidable within a cylinder, said piston coupled to a striker portion for engagement with a tool, in which at least a portion of the piston or cylinder or both have a ceramic coating;

a pressure unit for building up a charge of water under pressure and directing the charge of water under pressure towards a face of the piston; and valve means fluidly coupled to said cylinder for controlling the charge of water to and from the cylinder.

2. An impulsive unit as claimed in claim 1, wherein the ceramic coating contains a metal oxide.

3. An impulsive unit as claimed in claim 1, wherein the ceramic coating is an aluminium oxide-titanium dioxide composite.

4. An impulsive unit as claimed in claim 1, wherein the piston and cylinder are substantially cylindrical.

5. An impulsive unit as claimed in claim 4, wherein a clearance between an internal diameter of the cylinder and an external diameter of the piston is between 8 and 10 micrometers.

6. An impulsive unit as claimed in claim 1, wherein an internal wall of the cylinder is formed by a sleeve.

7. An impulsive unit as claimed in claim 1, wherein the pressure unit is charged with between 5 and 10 cc of gas at between a pressure falling generally 60 and 70 bar.

8. An impulsive unit as claimed in claim 1, wherein the valve means includes a spool valve which is slidable with respect to the cylinder.

9. An impulsive unit as claimed in claim 1, wherein the valve means is adapted to operate when supplied with pressurized water at a flow rate of between 20 and 30 liters per minute.

10. An impulsive unit as claimed in claim 9, which is adapted to operate when the supplied water is pressurized to between 100 and 110 bar.

11. An impulsive unit as claimed in claim 9, wherein the impulsive unit is adapted to deliver approximately 1350 blows per minute to the tool when the supplied water flow rate is 20 liters per minute.

12. An impulsive unit as claimed in claim 9, wherein the impulsive unit delivers approximately 1900 blows per minute to the tool when the supplied water flow rate is 30 liters per minute.

13. An impulsive unit as claimed in claim 1, wherein the striker portion engages the tool directly.

14. An impact tool comprising:

a housing including walls that define a cylinder, a piston disposed in said cylinder, wherein at least one of said walls, or said piston, or both include a ceramic coating; and a water supply means for supplying water to the impact tool from a closed loop supply.

15. An impact tool as claimed in claim 14, wherein the water supply means includes a 10 μm filter for filtering the water supplied to the impact tool.

16. An impact tool as claimed in claim 14, wherein the water supply means includes a cooler for cooling the water supplied to the impact tool.

17. An impact tool as claimed in claim 14, wherein the impact tool is a jack hammer.

18. An impact tool as claimed in claim 14, wherein the impact tool is a rock drill.

* * * * *